US010443296B2

(12) United States Patent
Rosenmarkle et al.

(10) Patent No.: US 10,443,296 B2
(45) **Date of Patent: *Oct. 15, 2019**

(54) APPARATUS AND TECHNIQUES FOR DOOR OPENER SYSTEMS

(71) Applicant: GTO Access Systems, LLC, Tallahassee, FL (US)

(72) Inventors: Steven Rosenmarkle, Tallahassee, FL (US); Mark Lawrence, Tallahassee, FL (US); Matthew Kirkland, Cantonment, FL (US); Alexandra Rolon, Atlanta, GA (US)

(73) Assignee: GTO Access Systems, LLC, Tallahassee, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/115,006

(22) Filed: Aug. 28, 2018

(65) Prior Publication Data

US 2019/0063141 A1 Feb. 28, 2019

Related U.S. Application Data

(63) Continuation of application No. 15/945,353, filed on Apr. 4, 2018, now Pat. No. 10,087,673, which is a (Continued)

(51) Int. Cl.
*E05F 15/77* (2015.01)
*G07C 9/00* (2006.01)

(Continued)

(52) U.S. Cl.
CPC ..... *E05F 15/77* (2015.01); *E05F 15/40* (2015.01); *E05F 15/60* (2015.01); *E05F 15/668* (2015.01);

(Continued)

(58) Field of Classification Search
CPC ..... G07C 9/00182; G07C 9/0081; G07C 2009/009287; E05Y 2900/106
See application file for complete search history.

(56) References Cited

U.S. PATENT DOCUMENTS 3,816,745 A * 6/1974 Primm ..... B66B 13/26 250/221
5,969,637 A * 10/1999 Doppelt ..... G07C 9/00817 318/266

(Continued)

OTHER PUBLICATIONS

"U.S. Appl. No. 15/069,070, Non Final Office Action dated Oct. 5, 2017".

(Continued)

*Primary Examiner* — Nabil H Syed
(74) *Attorney, Agent, or Firm* — Schwegman Lundberg & Woessner, P.A.

(57) ABSTRACT

Embodiments of a system and method for controlling a door are generally described herein. A door opener system can include a head unit. The system can include a wall station, a controller, or a wireless transmitter. The wall station can be inside a room, the room including the door and the controller can be outside the room. The wireless transmitter can be portable. The wall station, controller, or wireless transmitter can be used to control the head unit. The head unit can be used to open or close the door.

20 Claims, 12 Drawing Sheets

Related U.S. Application Data continuation of application No. 15/069,070, filed on Mar. 14, 2016, now abandoned.

(60) Provisional application No. 62/132,793, filed on Mar. 13, 2015.

(51) Int. Cl.

| | |
|---|---|
| ***E05F 15/72*** | (2015.01) |
| ***E05F 15/60*** | (2015.01) |
| ***E05F 15/40*** | (2015.01) |
| ***E05F 15/668*** | (2015.01) |
| *E05F 15/42* | (2015.01) |

(52) U.S. Cl.

CPC ..... *E05F 15/72* (2015.01); *G07C 9/00126* (2013.01); *G07C 9/00174* (2013.01); *E05F 2015/487* (2015.01); *E05Y 2400/50* (2013.01); *E05Y 2400/502* (2013.01); *E05Y 2400/512* (2013.01); *E05Y 2400/54* (2013.01); *E05Y 2400/80* (2013.01); *E05Y 2400/814* (2013.01); *E05Y 2400/822* (2013.01); *E05Y 2600/452* (2013.01); *E05Y 2900/106* (2013.01); *G07C 9/0069* (2013.01); *G07C 2009/00769* (2013.01); *G07C 2009/00928* (2013.01)

(56) References Cited

U.S. PATENT DOCUMENTS

| | | | | |
|---|---|---|---|---|
| 6,181,255 | B1 * | 1/2001 | Crimmins ..... | G07C 9/00309 340/12.28 |
| 2005/0272372 | A1 * | 12/2005 | Rodriguez ..... | H04L 12/2803 455/66.1 |
| 2010/0097733 | A1 * | 4/2010 | E. ..... | H02H 1/0015 361/42 |
| 2015/0015369 | A1 * | 1/2015 | Lamb ..... | E05F 15/79 340/5.71 |
| 2016/0194912 | A1 * | 7/2016 | Fitzgibbon ..... | E05F 15/60 340/5.61 |
| 2017/0034485 | A1 | 2/2017 | Scalisi | |

OTHER PUBLICATIONS

"U.S. Appl. No. 15/945,353, Notice of Allowance dated May 24, 2018", 8 pgs.

* cited by examiner

APPARATUS AND TECHNIQUES FOR DOOR OPENER SYSTEMS

CLAIM OF PRIORITY

This patent application is a continuation of U.S. patent application Ser. No. 15/945,353, filed on Apr. 4, 2018, which is a continuation of U.S. patent application Ser. No. 15/069,070, filed on Mar. 14, 2016, which claims the benefit of priority to U.S. Provisional Patent Application Ser. No. 62/132,793, filed on Mar. 13, 2015, which are hereby incorporated by reference in their entirety.

BACKGROUND

Garage or overhead doors can be opened manually or using an electric motor to operate the door. Such doors can be constructed from a variety of materials including steel, aluminum, or wood, for example, and can include unitary, sectional, or roll-up configurations. One or more of linear springs, torsion springs, or counterweights can be used to assist in reducing a load on the operator, whether the operation of the door is manual or electric. Electrically-operated doors can be triggered using a hardwired switch (e.g., a "doorbell" switch, key switch, or "dumb" keypad) or in response to a signal from a simple wireless transmitter such as located in a vehicle.

BRIEF DESCRIPTION OF THE DRAWINGS

In the drawings, which are not necessarily drawn to scale, like numerals can describe similar components in different views. Like numerals having different letter suffixes can represent different instances of similar components. The drawings illustrate generally, by way of example, but not by way of limitation, various embodiments discussed in the present document.

DETAILED DESCRIPTION

Systems and methods for controlling a barrier opener system are described herein. In an example, a system provides a motorized barrier operator, a wall station, a controller, and a wireless transmitter. The wall station, controller, and wireless transmitter can be configured to communicate with each other wirelessly. The wall station can communicate with the motorized barrier operator using a wired connection. The controller and the wireless transmitter can be configured to communicate directly with the motorized barrier operator wirelessly or with the wall station wirelessly. In another example, the controller can communicate with the wall station or the motorized barrier operator using a wired connection. The motorized barrier operator can be configured to open and close a barrier of an area at least partially enclosed by the barrier.

Reference is made in this disclosure to a "garage door," a "garage," a "garage door opener," a "garage door opener system," and the like. The references to the word "garage" in this disclosure can generally refer to an enclosed space with a door, where the door can be actuated by a motorized operator. Without departing from the scope of the subject matter described herein, enclosures other than a "garage" can include a door or barrier actuated by a motorized operator, such as structures that can include a "silo," a "room," a "barn," a "storage unit," a "shed," or the like. For example, the systems and methods described herein can be used to control a door or barrier included as a portion of a barn, such as including a barn door and an accompanying barn door opener, or a storage unit, such as having a door and an accompanying storage unit door opener, as illustrative examples. Accordingly, use of the word "garage" is generic and does not limit potential uses of a opener systems herein only literally to structures used as a garage for vehicles.

Figure 1:
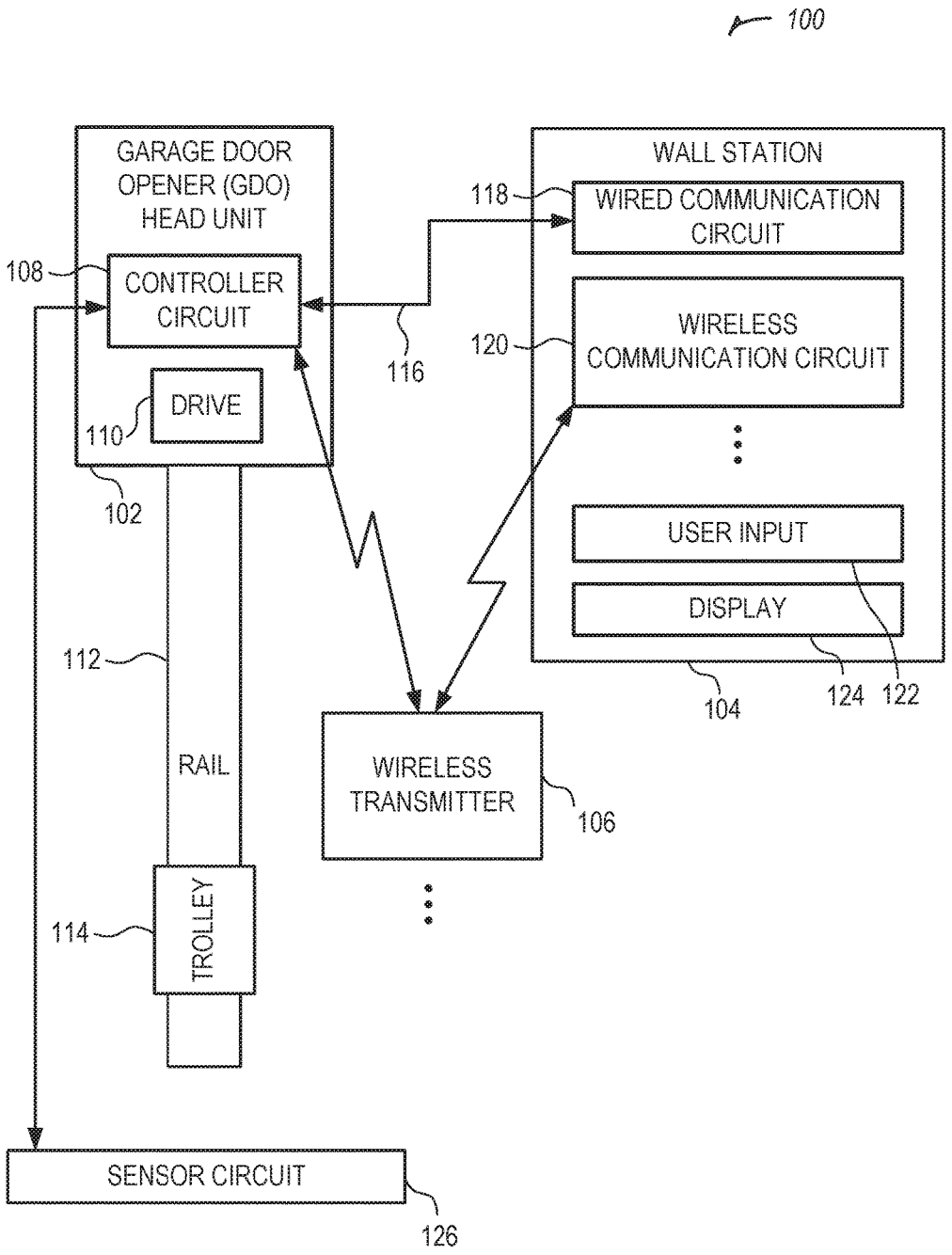
FIG. 1 illustrates generally an example of a garage door opener system in accordance with some embodiments.

FIG. 1 illustrates generally an example of a garage door opener system 100 in accordance with some embodiments. The phrase garage door opener ("GDO") is used generally herein, however, the GDO system 100 can be used in other applications such as in light commercial or residential applications for controlling or monitoring moveable doors for spaces other than garage spaces. The system 100 can include a GDO head unit 102, such as can include an electric drive 110 coupled to a trolley 114 along a rail 112 on which the trolley 114 operates, such as using a chain, cable, or screw drive, for example. The trolley can be coupled to a moveable door through a linkage, such as including a release mechanism to allow manual operation of the door. In an example, the door, trolley, or rail configuration can be established such as to prevent disengagement of the trolley by someone on the exterior of the door, to enhance security. The drive system can include a two-pulley configuration, such as to reduce chain freeplay, slap, or noise associated with operation of the drive 110 and trolley 114. The trolley 114 can have a disengagement lever. In an example, the disengagement lever can be disengaged from inside a garage but not from outside the garage, such as to help prevent break-ins.

The controller circuit 108 can be coupled to, or can include, one or more sensors. For example, the controller circuit 108 can be coupled to a separate sensor circuit 126 (e.g., an optical sensor comprising an optical source and an optical receiver such as to provide a light curtain or beam, such as can be used to inhibit operation of the drive 110 or to trigger reversal of the drive 110).

The GDO head unit 102 can include a controller circuit 108, such as can include one or more printed circuit board (PCB) assemblies. The controller circuit can include a finite state machine, a microcontroller, or microprocessor-based circuitry, such as to provide appropriate control signals to operate the drive 110. The controller circuit 108 can be coupled to other portions of the system 100, such as including a conductive coupling 116 to a wall station 104. In one approach, a doorbell switch or other device can be used to receive a user input and signal the controller circuit 108 to change the state of a door operated by the drive 110, such as to open or close the door. In another approach, the conductive coupling 116 can be coupled to wired communication circuit 118 included as a portion of the wall station 104, such as to allow control of the GDO head unit 102 using the wall station 104. The wall station can include other circuitry, such as one or more wireless communication circuits (e.g., a wireless communication circuit 120), a user input 122, and a display 124. The user input 122 can include a keypad, pushbuttons, or rotary controls for example, or the user input 122 can be integrated with the display 124, such as providing one or more of soft-keys along a perimeter of the display 124 or a touch-screen interface as a portion of the display 124 assembly.

The system 100 can include wireless transmitters such as a wireless transmitter 106. In one approach, the wireless transmitter 106 can include circuitry to transmit a wireless signal including a fixed or rolling access code to trigger operation of the GDO head unit 102 to operate the door. In another example, the wireless transmitter 106 can include circuitry to communicate with a wireless communication circuit 120 of the wall station. For example, the GDO head unit 102 can include circuitry configured to wirelessly receive only, while the wall station can include one or more transceiver circuits.

The present inventors have developed various advanced features and improvements such as can be included as a portion of the system 100 shown in the example of FIG. 1.

The GDO head 102 can include other circuits or features, such as being coupleable to a battery. The battery can include a rechargeable battery, such as to provide backup operation of a lighting unit included as a portion of the GDO head assembly 102. For example, the controller circuit 108 can provide charge management or other battery management, including detection of battery presence or battery status (e.g., low battery, battery needs replacing, AC disconnected and running on battery, battery charging, etc.).

The controller circuit 108 or other portion of the system 100 can be configured to provide a digital representation of an obstruction state of a door being operated by the GDO head unit 102. For example, the sensor circuit 126 can be an optical sensor providing a light beam across an opening. The controller circuit 108 can be configured to detect and report various obstruction or other system states such as "beam blocked"; "beam cleared"; "door position" or another representation of a position encoder output; drive 110 current, drive 110 operating direction or trolley 114 operating direction (e.g., to sense wrong direction operation as in the case of an installation error or mechanical fault). Door position sensing can be absolute, such as based on an encoder position, or relative, such as based upon triggering one or more fixed or adjustable limit settings or a counter trigged by linear or rotational displacement. During extended periods where the door position is closed, one or more sensors or other portions of the system 100 can be powered down or placed into a reduced energy consumption (e.g., sleep mode). For example, optical sources or detectors included as a portion of a photo-detector beam across the door opening can be de-powered when the door is in a closed state or according to one or more other criteria.

The GDO head 102 can include, or can be coupled to, an audible output such as an alarm circuit or speaker, such as to provide diagnostic information or system state information as mentioned above. For example, an audible signature can be indicative of a particular diagnostic state or code, such as using one or more of frequency, duty cycle, or pattern of an alarm signal to identify a particular diagnostic state or code. Such system state information can be provided to another portion of the system 100, such as to the wall station 104 for presentation to a user via the display 124, or for transmission to another system such as a centralized home monitoring or control system or data repository located elsewhere.

In an example, obstruction information or other system state information can be communicatively coupled to the wall station 104 from the GDO head unit 102 such as using the conductive coupling 116. For example, the conductive coupling 116 can include a power supply feed to the wall station 104, and such a power supply feed can include direct current (DC) operating energy for the wall station 104, along with modulated serial data. In an example, the conductive coupling 116 can carry an analog signal (e.g., a door opening or operating signal or a pulse-width modulated signal), DC operating energy, and modulated serial data over two conductors or using more than two conductors. In an example, one or more of the wall station 104 or the GDO head unit 102 can include capability to automatically sense whether digital or analog communication is available between a head unit 102 and the wall station 104 or other accessories such as a digital or analog control input, including determining whether to initiate communication, and which parameters or protocol to use. Such protocols can include selecting between a 30 mA, 200 mA, or 250 mA signaling mode using a Universal Synchronous/Asynchronous Receive and Transmit (QSART) or Universal Asynchronous Receive and Transmit (UART) scheme, analog signaling scheme, or simple dry contact (e.g., "doorbell") control input, such as without requiring a user to manually configure the interface mode to use the appropriate signaling or control scheme.

The GDO head unit 102 can include a lighting unit, such as a light-emitting diode (LED) assembly (e.g., an LED array). The LED array can include a configurable lighting level (e.g., brightness or dimming), such as adjustable using information provided by the wireless transmitter 106 or the wall station 104. In an example, the GDO head unit 102 can detect a light level and report such a light level, including triggering illumination by the LED assembly or adjusting the brightness of the LED assembly in response to changing light conditions, time of day, or user input, for example.

The GDO head unit 102 can include one or more LEDs such as to provide diagnostic information to a user or installer. For example, one or more LEDs can be mounted in a recessed or enclosed portion of the GDO head unit 102, such as including a fold-down door or portion, to facilitate visualization of diagnostic status or assist in setup. The LEDs can include or can be configured to display battery status, such as battery absence, low battery, shorted battery (or other fault), low capacity, or no capacity, for example. In an example, battery status can be indicated using audible feedback or serial communication. In another example, RF or wireless data feedback can be sent via the one or more LEDs. For example, a green LED can blink if the GDO head unit 102 receives a first RF communication and a red LED can blink if the GDO head unit 102 receives a second RF communication. In another example, both the first and second RF communications can be received simultaneously.

The GDO head unit 102 can include an expansion interface, such as to provide access to field-installable or dealer-installable modular assemblies. The expansion interface can be configured to provide one or more of power, logic-level ports, serial communication, analog input, or pulse-width modulated outputs.

The GDO head unit 102 can be equipped or coupled to a "panic" feature, such as can be used to trigger audible and visual alerts in response to a user triggering a panic button. The panic button can be included as a portion of one or more of a hand-held wireless transmitter, the wall station 104, the head unit 102, or elsewhere. Other alert triggers can be included, such as fire warning or carbon monoxide warning. Different alerts can be indicated to a user using one or more of a different pattern, loudness, or frequency of audible warning, or using different patterns, colors, or brightness of visual (e.g., LED-based) indicators. For example, a lighting unit configured to provide ambient light can be configured to flash or change colors in relation to a detected alert condition.

Information indicative of carbon monoxide or fire can be detected using a sensor included as a portion of the GDO head unit 102, a sensor coupled to the GDO head unit 102, or a sensor located elsewhere (e.g., such as coupled to a centralized home monitoring system and communicatively coupled to the GDO 102 using the wall station 104 or other techniques). Similarly, the GDO head unit 102 can communicate an indication of a detected fire or carbon monoxide to the wall station 104, such as using the wired coupling 116. A detected carbon monoxide condition can be used to trigger operation of the drive 110 to open the door, such as to assist in abating accumulated carbon monoxide.

An LED lighting unit can be configured to conform to one or more portions of the mechanical housing of the GDO head unit 102, such as wrapping around three sides. The LED lighting unit can be modular, such as comprising a pluggable unit to allow dealer or field replacement or selection of a lighting unit, such as to provide a desired color temperature or brightness. The brightness can be adjustable, as mentioned above. During battery backup operation (e.g., if battery is installed and charged), brightness can be modulated (e.g., dimmed) to extend battery life or indicate that GDO unit 102 is operating under backup power. The LED lighting unit can be dimmable or controllable such as using a graphical-user-interface (GUI), such as provided at the wall station 104 or in response to control provided by a centralized home control system coupled to the wall unit 104, for example. In another example, the LED lighting unit can be controllable remotely (or monitor status remotely), such as while a user is at work or on vacation and physically remote from the wall station.

The wall station 104 can be configured to support a variety of wired or wireless communication schemes. For example, the wall station 104 can be configured to support wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards (ZigBee) protocols, or one or more other schemes such as Z-Wave. The Z-wave implementation can support a generalized "barrier" class and "multi-level" switch class to provide integration with home control or monitoring systems from other vendors.

In an example, the wall station 104 can be integrated in a wireless mesh network, such as included as a portion of a home control or monitoring system. The wall station 104 can act as a hub to receive errors, alerts, or other status information from the GDO head unit 102, such as to provide such information to other portions of the a home control or monitoring system, or to a centralized repository (e.g., a cloud-based service, an alarm monitoring service, or other system).

The wireless transmitter 106 can include a feature enabling one wireless transmitter 106 to clone, mimic, or automatically select a communication scheme according to an example provided by another transmitter. For example, the wireless transmitter 106 can be configured to receive information from another transmitter when the other transmitter is triggered, and then the wireless transmitter 106 can select an operating mode such that the GDO head unit 102 then responds to the wireless transmitter 106 for subsequent operations. An LED or other indicator on the GDO head unit 102 can provide a unique indication (such as color, frequency, or pattern of light output) indicative of whether rolling code or serial-number based schemes versus dipswitch, or other transmitter schemes are detected, such as during programming or pairing of wireless transmitters with the GDO head unit 102. In an example, the wireless transmitter 106 can be configured to allow a user to select whether to operate the transmitter in a "clone" mode as mentioned above, or to provide a unique arbitrary ID code or other representation corresponding to each button the transmitter 106.

The wireless transmitter 106 can include a wireless keypad, such as mountable inside or outside a space enclosed in part by the door operated by the GDO head unit 102. For example, the keypad can enable a user to securely control a state of the lighting unit of the GDO head unit 102, such as to turn on or turn off the light in response to a programmed code.

Figure 2:
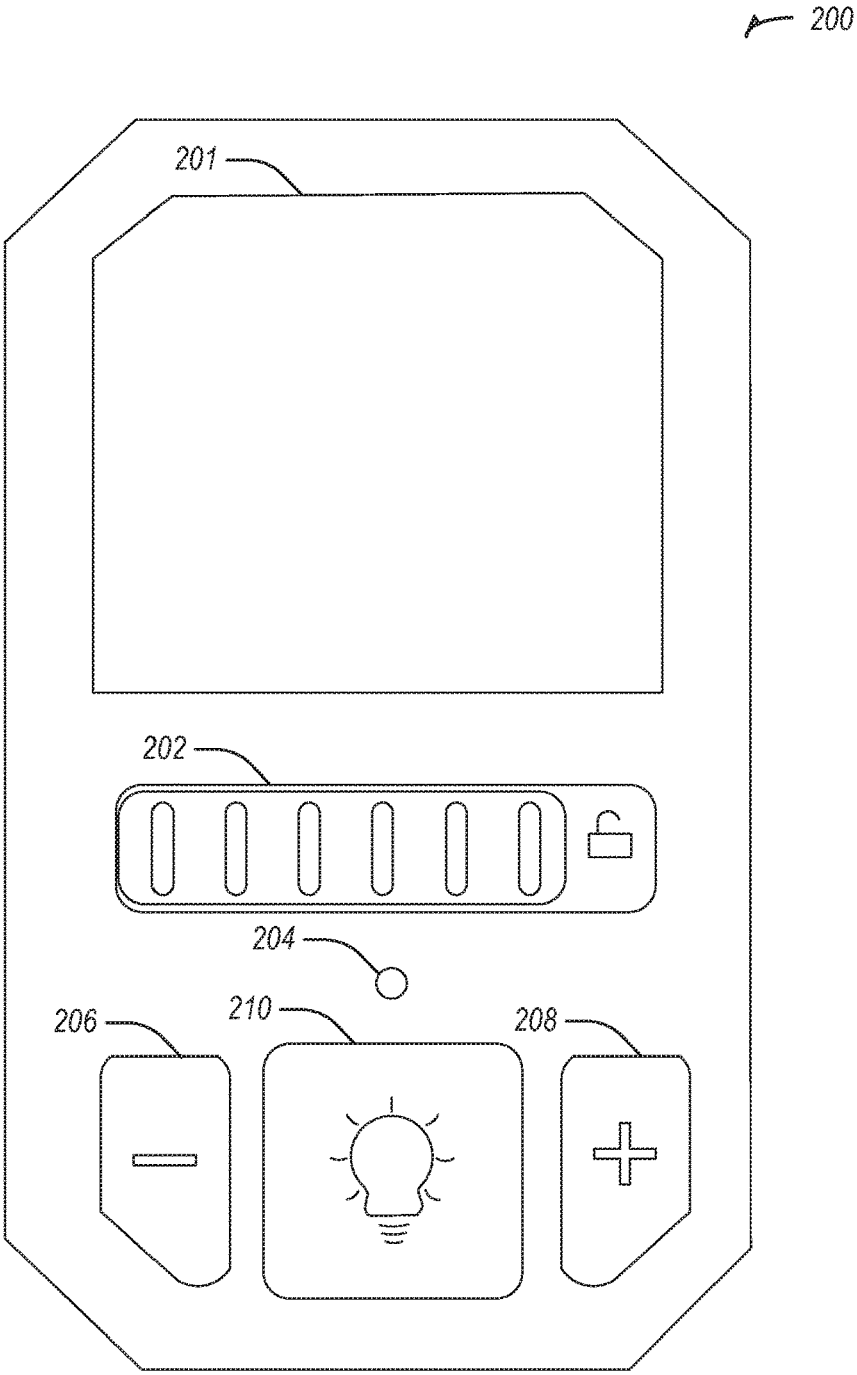
FIG. 2 illustrates a barrier wall station in accordance with some embodiments.

FIG. 2 illustrates a barrier wall station 200 in accordance with some embodiments. The wall station 200 includes a barrier cycle button 201, a locking mechanism 202, an indicator light 204, a light activator button 210, a light decrease button 206, and a light increase button 208. The light decrease button 206 and the light increase button 208 are configured to change intensity of an overhead light that can be activated or deactivated by the light activator button 210. The wall station 200 can be connected using a wired connection with a motorized barrier operator. The barrier cycle button 201 can be configured to send a signal to the motorized barrier operator to move a barrier up or down. The barrier cycle button 201 can cycle the barrier from among opening, closing, or stopping. For example, when the barrier is stopped, the barrier cycle button 201 can start the barrier moving (e.g., if the barrier is fully open and stopped, the barrier can close or if the barrier is fully closed and stopped, the barrier can open). When the barrier is moving, up or down, the barrier cycle button 201 can stop the barrier. Once stopped, the barrier cycle button 201 can restart the barrier moving in the same direction or can restart the barrier and move it in an opposite direction from a previous direction traveled.

The wall station 200 can be physically located inside an area with a barrier (e.g., inside a garage with a garage door). By being physically located inside the room, the wall station 200 can have more security (and provide more features) than being located outside the room, which can be less secure.

The indicator light 204 can indicate whether a connection between the wall station 200 and a motorized barrier operator is active or inactive. In another example, the indicator light 204 can indicate whether the wall station 200 is active or indicate a current status of connection between the wall station and a router or hub. The light activator button 210 can be used to activate or deactivate a light of a motorized barrier operator such as to illuminate a garage when the motorized barrier operator is mounted on a ceiling of the garage. For example, the motorized barrier operator light can be lit by pushing the light controller 210 button. In an example, the light remains on until the light controller 210 is pressed again or the motorized barrier operator is power cycled. When the light on the motorized barrier operator is on, pressing the light controller 210 can turn the light off.

In yet another example, the indicator light 204 can indicate that the locking mechanism 202 has been engaged. The locking mechanism 202 can be locked to initiate a vacation lock. The vacation lock can provide additional security for a GDO system. The locking mechanism 202 can be engaged to a locked position to prevent remote controls from opening a barrier, for example after the door is completely closed. In an example, the remotes can close the door, but not open it. In another example, the door can still be opened or closed by using the barrier cycle button 201. In an example, to signal that the vacation switch is locked, a motorized barrier operator light (e.g., one controlled by the light activator button 210) or the indicator light 204 can turn on or flash. For example, the indicator light 204 can include a red LED and can flash five times when a remote is activated in an attempt to open the door when the locking mechanism 202 is engaged. To turn off the vacation lock, the locking mechanism 202 can be disengaged (e.g., slid to a left position) to return the opener to normal operation.

Figure 3:
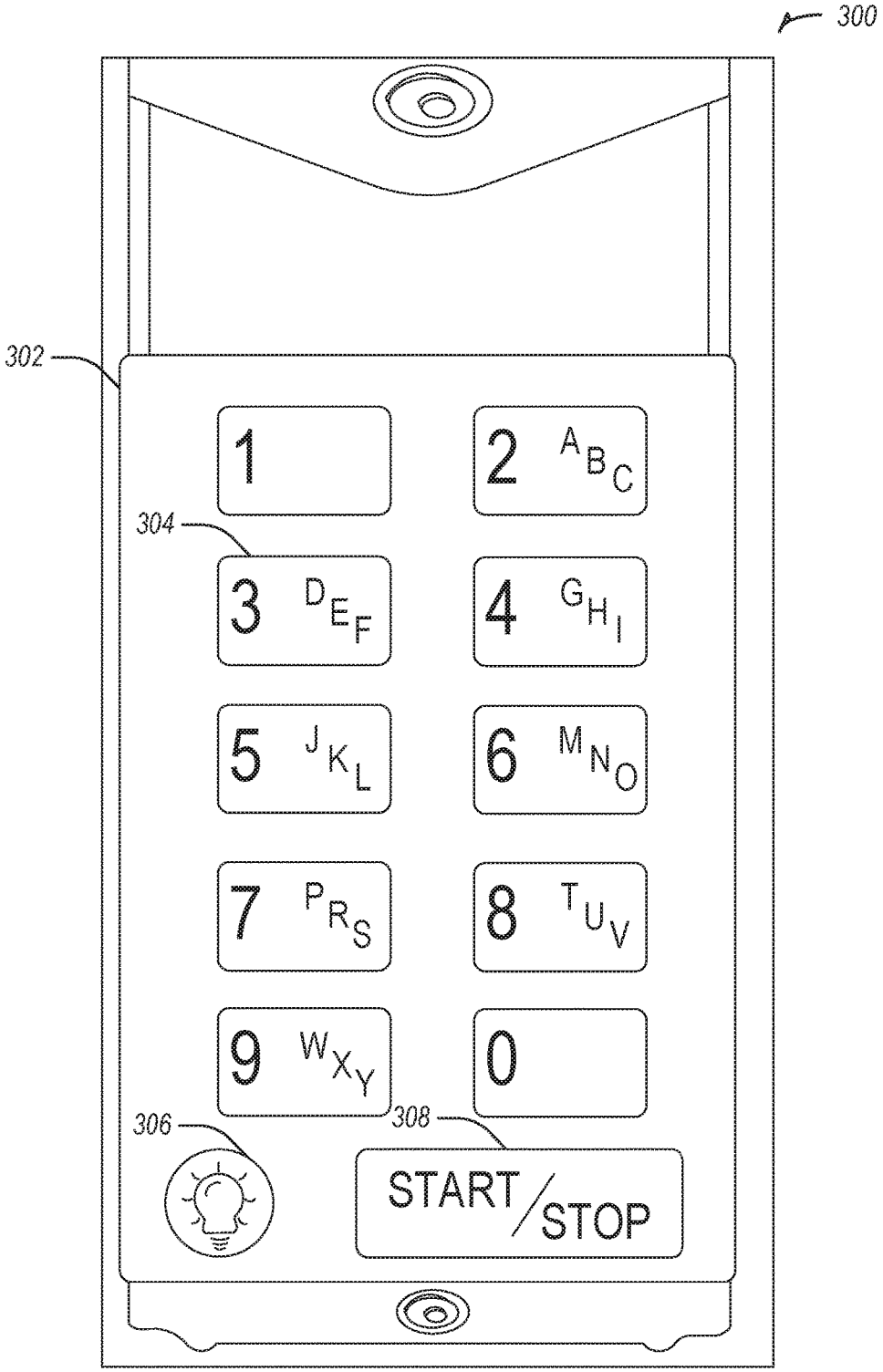
FIG. 3 illustrates a barrier controller in accordance with some embodiments.

FIG. 3 illustrates a barrier controller 300 in accordance with some embodiments. The barrier controller 300 includes a plurality of keys (e.g., key 304) on a touchpad 302. In an example, the touchpad 302 can slide or a slider can cover the touchpad 302, such as to prevent wear or weather from damaging the touchpad 302. In another example, the touchpad 302 can be covered by a hinged cover. The plurality of keys can be used to enter a password or code. The password or code can be compared to a preselected password or code stored in memory of the controller 300, retrieved from a wall unit, retrieved from a motorized barrier operator, or the like. When an accurate password or code is entered, the controller 300 can cause a motorized barrier operator to open or close a barrier. The controller 300 can be physically located outside of a room with a door, such as on an outside wall of the room (e.g., adjacent to a barrier outside a garage). The controller 300 can be less secure than a wall station, since the controller 300 is outside the room. The controller 300 can have less features (e.g., not having a locking mechanism to activate a vacation lock) than a wall station due to the unsecure location. In another example, to provide a layer of security given the unsecure location, activating the controller 300 can require a password or code to be entered in advance of use.

The touchpad 302 includes a light button 306, the light button 306 configured to activate a light, such as a light on a motorized barrier operator. In an example, the light button 306 and the light controller 210 can control the same light.

The touchpad 302 includes a start/stop button 308. The start/stop button 308 can be used to activate a barrier, such as to move it up or down. In an example, the start/stop button 308 can communicate with a motorized harder operator directly to cause the motorized barrier operator to open and close the barrier. In another example, the start/stop button 308 can communicate with a wall station that can then relay a command to the motorized barrier operator to open or close the barrier. In an example, opening the barrier can require a valid access code to be entered on the keypad 302 prior to allowing the start/stop button 308 to function. In this example, the barrier can be closed without entering a valid access code. In another example, opening and closing the barrier can require a valid access code. The start/stop button 308 can be used to stop the barrier (whether it is currently opening or closing), or to cause the barrier to move (e.g., in the direction it was previously moving or if it is at an end location, to start).

The barrier controller 300 can be associated with a motorized barrier operator. For example, the motorized barrier operator can have a predefined code (e.g., printed on the motorized barrier operator or in an instruction manual) and the barrier controller 300 can be associated with the motorized barrier operator by entering the predefined code. The association can occur after a learn button is pressed on the motorized harder operator, and then the predefined code entered by the barrier controller 300. The barrier controller 300 can communicate directly with the motorized barrier operator wirelessly, or can communicate via a wall unit (e.g., wirelessly from the barrier controller 300 to the wall unit and then over a wired or wireless connection from the wall unit to the motorized barrier operator).

Figure 4:
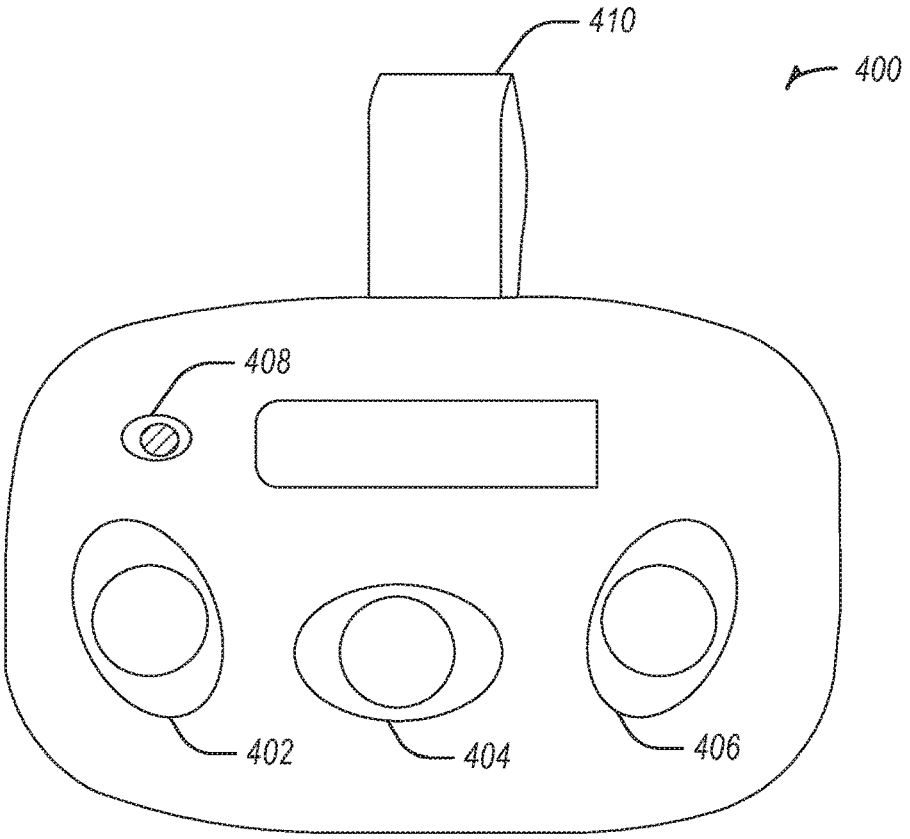
FIG. 4 illustrates a barrier wireless transmitter in accordance with some embodiments.

FIG. 4 illustrates a wireless transmitter 400 in accordance with some embodiments. The wireless transmitter 400 can also be referred to as a wireless transmitter. The wireless transmitter 400 includes a button or a plurality of buttons, such as a first button 402, a second button 404, and a third button 406. The wireless transmitter 400 includes an indicator light 408. In an example, the wireless transmitter 400 can include a clip 410, such as to attach to clothing or a part of a car (e.g., a sun visor). The wireless transmitter 400 is portable and can communicate wirelessly. In an example, the wireless transmitter 400 can communicate directly with a motorized barrier operator wirelessly. In another example, the wireless transmitter 400 can communicate with a controller, such as controller 300, which in turn can communicate with the motorized barrier operator wirelessly or can communicate with a wall unit that can then communicate with the motorized barrier operator wirelessly or with a wired connection. In yet another example, the wireless transmitter 400 can communicate with the wall unit wirelessly, and the wall unit can then communicate with the motorized barrier operator. The wireless transmitter 400 can be configured to use a single one of these communication methods or can be configured to use more than one. For example, the wireless transmitter 400 can be configured to communicate with the motorized barrier operator directly by associating the wireless transmitter 400 with the motorized barrier operator using a learn button on the motorized barrier operator and pressing the first button 402 once or multiple times, or by pressing a series of buttons. In an example, the wireless transmitter 400 can transmit only.

In an example, the wireless transmitter 400 is configured to transmit over a 433 MHz or a 318 MHz band. In another example, the wireless transmitter 400 is configured to communicate over a IEEE 802.15* specification using a ZigBee transmitter or transceiver. In yet another example, the wireless transmitter 400 is configured to communicate using a Wi-Fi network.

The wireless transmitter 400 can be configured to clone or learn a dual in-line package (DIP) switch code or setting. For example, when the first button 402 and the third button 406 are pressed and held for a period of time (e.g., 5 seconds), the indicator light 408 can illuminate. A button (e.g., one of buttons 402 to 406) can be pressed to select a desired button to program with the learned or cloned DIP switch code. A DIP switch transmitter can be held facing the wireless transmitter 400. When a button to transmit on the DIP switch transmitter is pressed, the wireless transmitter 400 can learn or clone the DIP switch code. In an example, the indicator light 408 can blink twice to indicate that the wireless transmitter 400 has successfully learned or cloned the code. The selected button can then be used to open or close a barrier, for example.

The wireless transmitter 400 can be configured to create a DIP switch code. In an example, the first button 402 and the third button 406 can be pressed and held at the same time for about 5 seconds. The indicator light 408 can illuminate to indicate the selection and the buttons can be released. If a button (e.g., 402 to 406) is then quickly pressed twice, a DIP switch code will be created. The indicator light can then blink twice showing successful creation of the DIP switch code. The selected button can transmit the DIP switch code as indicated by the indicator light being solid on when the button is pressed.

The wireless transmitter 400 can be configured to delete a DIP switch code. In an example, the first button 402 and the third button 406 can be pressed and held at the same time for about 5 seconds. The indicator light 408 can illuminate to indicate the selection and the buttons can be released. If a button (e.g., 402 to 406) is then held for approximately 5 seconds, a DIP switch code assigned to that button will be removed. The indicator light can then blink showing successful deletion of the DIP switch code. The selected button can then transmit the a GDO serial number packet as a default, as indicated by the indicator light blinking when the selected button is pressed.

Figure 5:
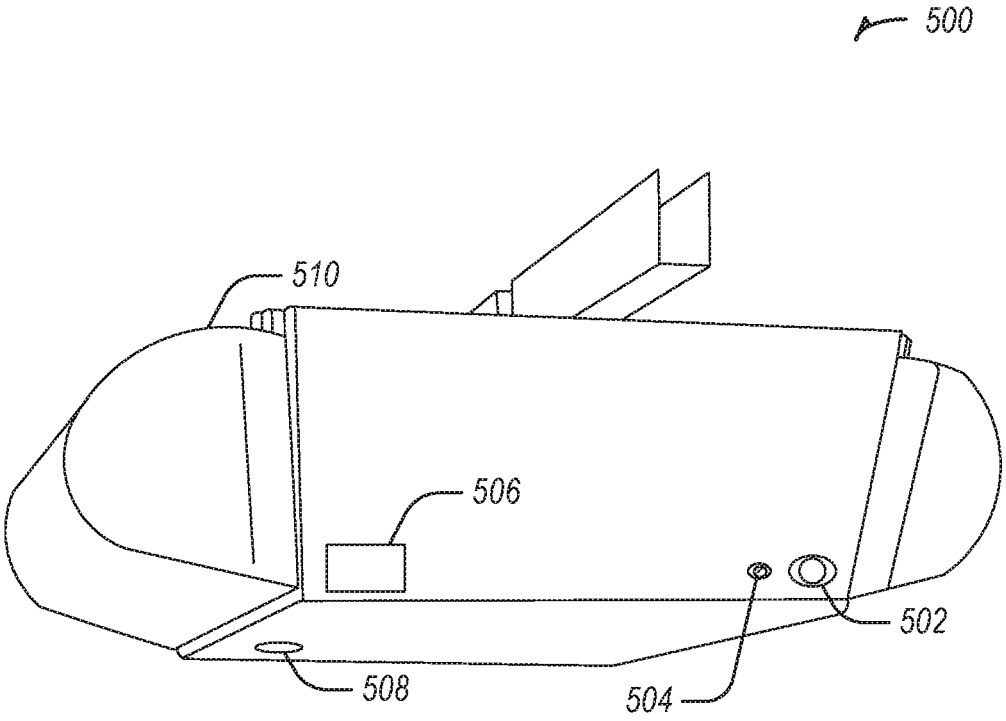
FIG. 5 illustrates a motorized barrier operator in accordance with some embodiments.

FIG. 5 illustrates a motorized barrier operator 500 in accordance with some embodiments. The motorized barrier operator can include a configuration button 502, an indicator light 504, an expansion port 506, a carbon monoxide detector 508, or an illumination light 510. The configuration button 502 can be used to initially connect with a wall station, a controller, or a wireless transmitter. The indicator light 504 can be used to indicate battery issues, power status, connection status, or the like.

The indicator light 504 or the illumination light 510 can be used to indicate that an initial connection can be made while the indicator light 504 or the illumination light 510 are illuminated. The indicator light 504 or the illumination light 510 can be used to indicate a wireless connection with the wall station, controller, or wireless transmitter. In another example, the indicator light 504 or the illumination light 510 can be used to alert a user to an error or condition. For example, the indicator light 504 or the illumination light 510 can be used to flash or blink a predetermined number of times to alert a user to a specific condition or error. In an example, the illumination light 510 can flash a distinct number of times for respective conditions. For example, the illumination light 510 can flash according to Table 1, shown below.

Illumination Light Flashing Conditions

| LAMP FLASHES TROUBLE CODE | PROBLEM | CAUSE | REMEDY |
|---|---|---|---|
| 1 Flash | No problem | Remote control entered into memory | Add any additional remote controls. |
| 2 Flashes | Door won't close | Shorted wall station wires | Check wall station wires. Be sure both are connected to the terminal screws. Check a staple in the wall station wires. Remove any staples compressing the wire. |

-continued

Illumination Light Flashing Conditions

| LAMP FLASHES TROUBLE CODE | PROBLEM | CAUSE | REMEDY |
|---|---|---|---|
| 3 Flashes | Door won't close | Safety beam obstacle | Check for obstacles. Align the safety beam. |
| 4 Flashes | Door reverses or won't open or close | Open or close force exceeded | Check for obstruction or binding of garage door. Perform field reset if necessary. |
| 5 Flashes | Door won't open from remote control | Remote was activated while vacation switch was locked | Unlock vacation switch on wall station |
| 6 Flashes | Motor ran longer than 30 seconds | Mechanical or electronic failure | Call your local garage door professional |
| 7 Flashes | Limit error | Encoder has detected error or down limit set above up limit | Re-set the open and close limits. If error occurs again, call your local garage door professional |

The carbon monoxide detector 508 can detect carbon monoxide above a threshold and send a notification to initiate an alert. The motorized barrier operator 500 can issue an alert by flashing the illumination light 510 or sounding an audible alarm. In another example, the motorized barrier operator 500 can automatically open a barrier to ventilate the area. In another example, the carbon monoxide detector 508 can alert a secondary device using a Zwave, Wi-Fi, or other network connection. For example, the carbon monoxide detector 508 can remotely alert a mobile device of a user.

Figure 6:
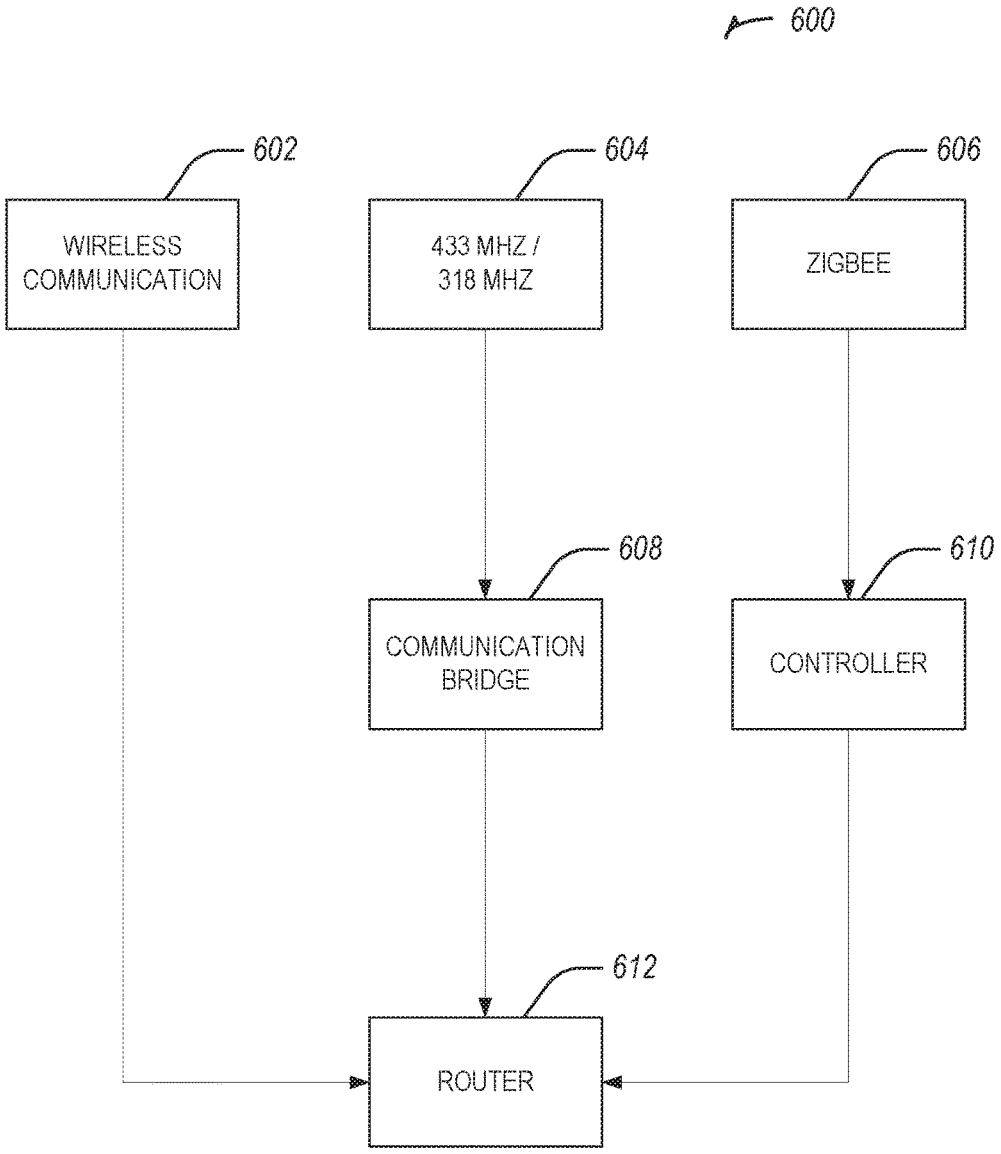
FIG. 6 illustrates a block diagram of communication connections for controlling a barrier opener in accordance with some embodiments.

FIG. 6 illustrates a block diagram 600 of communication connections for controlling a barrier opener in accordance with some embodiments. The block diagram 600 illustrates different paths that a wireless signal can take to communicate with a router 612, such as a router 612 in a wall station or a controller. In an example, a wireless transmitter can communicate using a wireless communication method such as Wi-Fi at block 602 and communicate directly with the router 612. In another example, a wireless transmitter can communicate over a 433 MHz or 318 MHz band connection at block 604. The 433 MHz or 318 MHz band connection can be between the wireless transmitter and a communication bridge 608, which can then communicate with the router 612. The communication bridge 608 can be in a wall unit or a controller. In yet another example, a wireless transmitter can communicate using an IEEE 802.15 communication standard to communicate with a controller 610. The IEEE 802.15 can be a ZigBee standard connection at block 606. The controller 610 can relay the message received using the ZigBee connection to the router 612. In an example, the controller 610 or the communication bridge 608 can connect with the router 612 using a wired connection.

Figure 7:
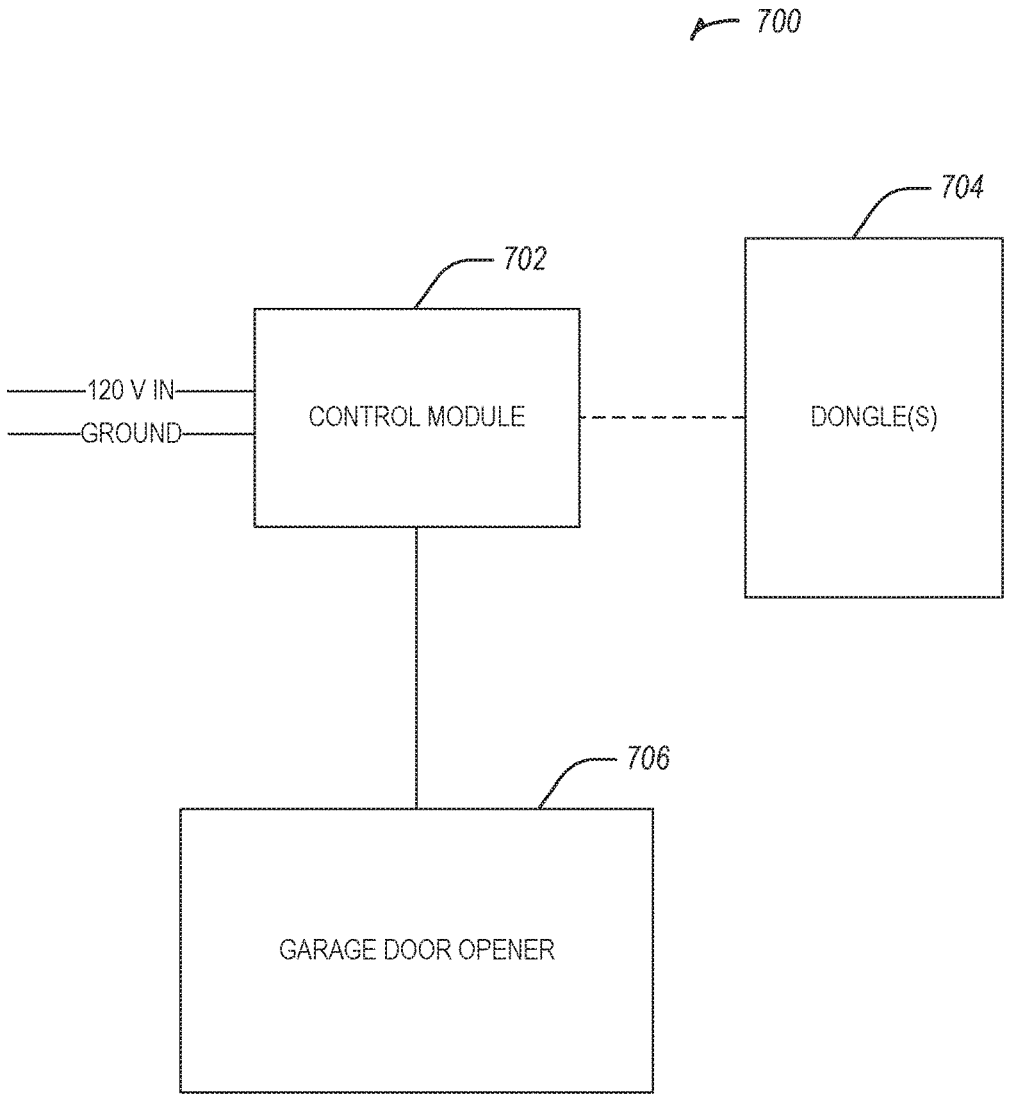
FIG. 7 illustrates a block diagram of a wall station barrier opener system in accordance with some embodiments.

FIG. 7 illustrates a block diagram 700 of a wall station barrier opener system in accordance with some embodiments. The block diagram 700 includes a control module 702, such as one found in a controller (e.g., controller 300). The control module 702 is configured to receive a 120 V input and a ground wire for power. In another example, the control module 702 can receive power and data over a shared wire. The control module 702 can connect with a dongle(s) 704. In an example, a plurality of dongles can communicate with the control module 702. In an example, the control module 702 can connect with a barrier opener 706 (e.g., a motorized barrier operator). The control module 702 can be used to directly send controls to the barrier opener 706 to manipulate a door. In another example, the control module 702 can receive a command from the dongle(s) 704 and act as a relay to send the command on to the barrier opener 706.

Figure 8:
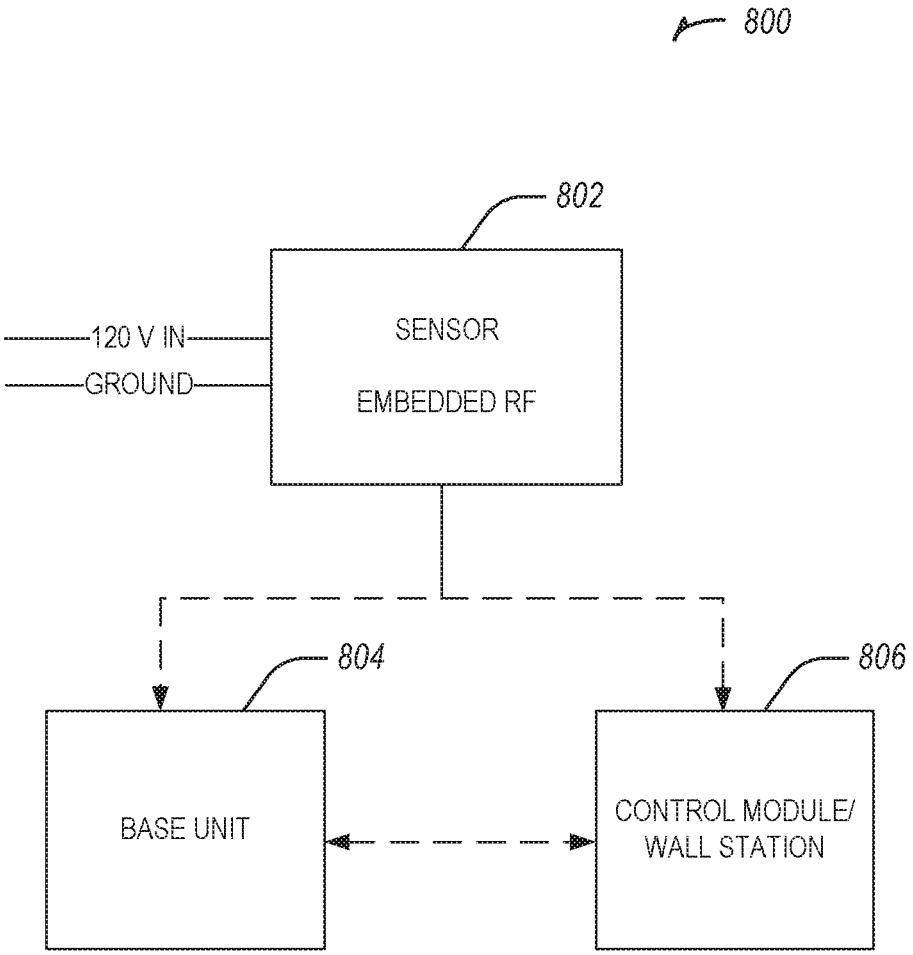
FIG. 8 illustrates a vehicle sensor system in accordance with some embodiments.

FIG. 8 illustrates a vehicle sensor system 800 in accordance with some embodiments. The vehicle sensor system 800 can include a sensor 802, such as an embedded radio frequency (RF) sensor to determine when the vehicle is close to a base unit 804. For example, the sensor 802 can receive power (e.g., using 120 V input and ground wires) from the vehicle and send a signal using a 433 MHz band output. When the vehicle is close enough to the base unit 804 or a control module or wall station 806, the base unit 804 or the control module or wall station 806 can receive the RF signal over the 433 MHz band and activate the base unit 804 to open a door. When the signal is received by the control module or wall station 806, the control module or wall station 806 can send a wired or wireless signal to the base unit 804 to activate the door. When the signal is received by the base unit 804, the base unit 804 can automatically activate the door. This allows the door to automatically open when the vehicle approaches and is within the 433 MHz band range using the RF sensor.

Figure 9:
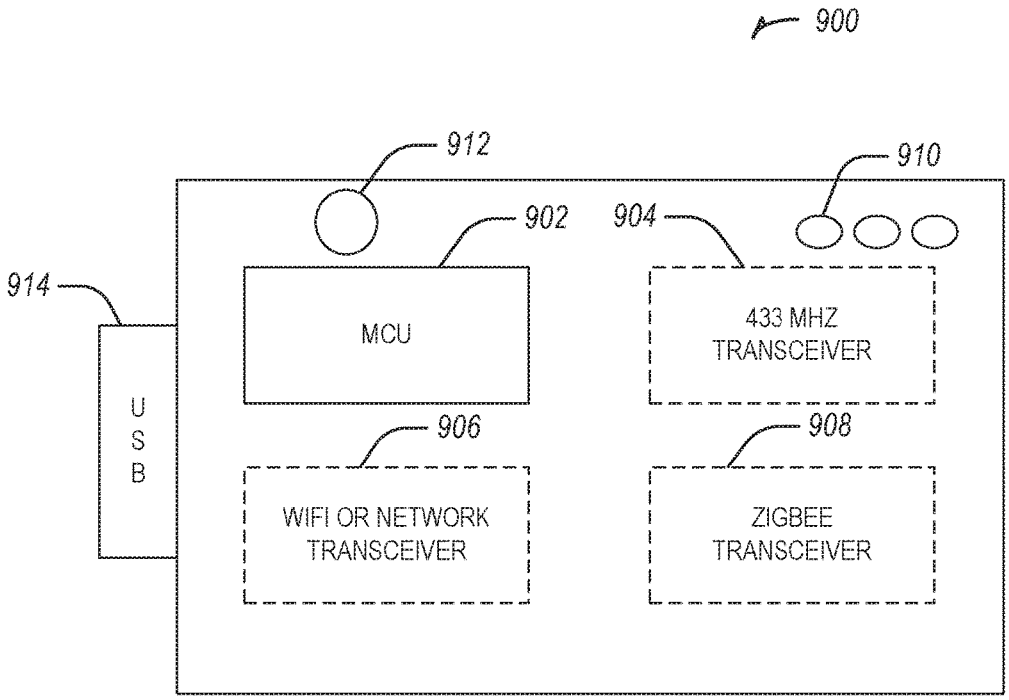
FIG. 9 illustrates a dangle for remotely opening a barrier in accordance with some embodiments.

FIG. 9 illustrates a dongle 900 for remotely opening a barrier in accordance with some embodiments. The dongle 900 can include a USB port 914 for connecting to a motorized barrier operator, a wall station, or a controller. For example, the USB port 914 can be used with the motorized barrier operator 500 of FIG. 5 and plug into the expansion port 506. In an example, when the USB port 914 is connected to the expansion port 506, the dongle 900 can be automatically configured to communicate wirelessly with the motorized barrier operator when they are disconnected. In another example, when the USB port 914 is connected to the expansion port 506, the dongle 900 can be used to send a signal to a controller wirelessly. In this example, the motorized barrier operator can be a unit without independent wireless capabilities that can be upgraded to a wireless unit using the dongle 900. Further to this example, the dongle 900 can be configured to communicate wirelessly from the head unit to a wall station or a controller.

The dongle 900 can include a push button 912 and one or more lights (e.g., LED 910). The push button 912 can be used to transmit wireless signals to a controller, wall station, or motorized barrier operator. The lights can be used to indicate connection status, initiation setup details, or battery level. The dongle 900 can include a battery. The dongle includes a microcontroller (MCU) 902, such as an integrated circuit, system on a chip, or the like. The microcontroller 902 can be used to interpret inputs from the push button 912, activate the lights (e.g., LED 910), or send or receive information using transceivers. The dongle 900 can include a transceiver or multiple transceivers. For example, a 433 MHz transceiver 904, a Wi-Fi or network transceiver 906, or a ZigBee transceiver 908. With the different transceivers 904-908, the push button 912 and the lights (e.g., LED 910) can have different uses. For example, the push button 912 can be used for pairing the dongle 900 when the transceiver is the 433 MHz transceiver 904, activate a Wi-Fi protected setup (WPS) when the transceiver is the or network transceiver 906, or connect to a remote device when the transceiver is the ZigBee transceiver 908. The lights can indicate power, data transmitting, data receiving, Wi-Fi availability, internet access, or a connection status.

In another example, the transceiver options shown in dongle 900 can be included in different wall stations. For example, instead of the dongle 900 to plug in to a wall station, the wall station can incorporate the MCU 902 and one of the transceivers 904-908.

Figure 10:
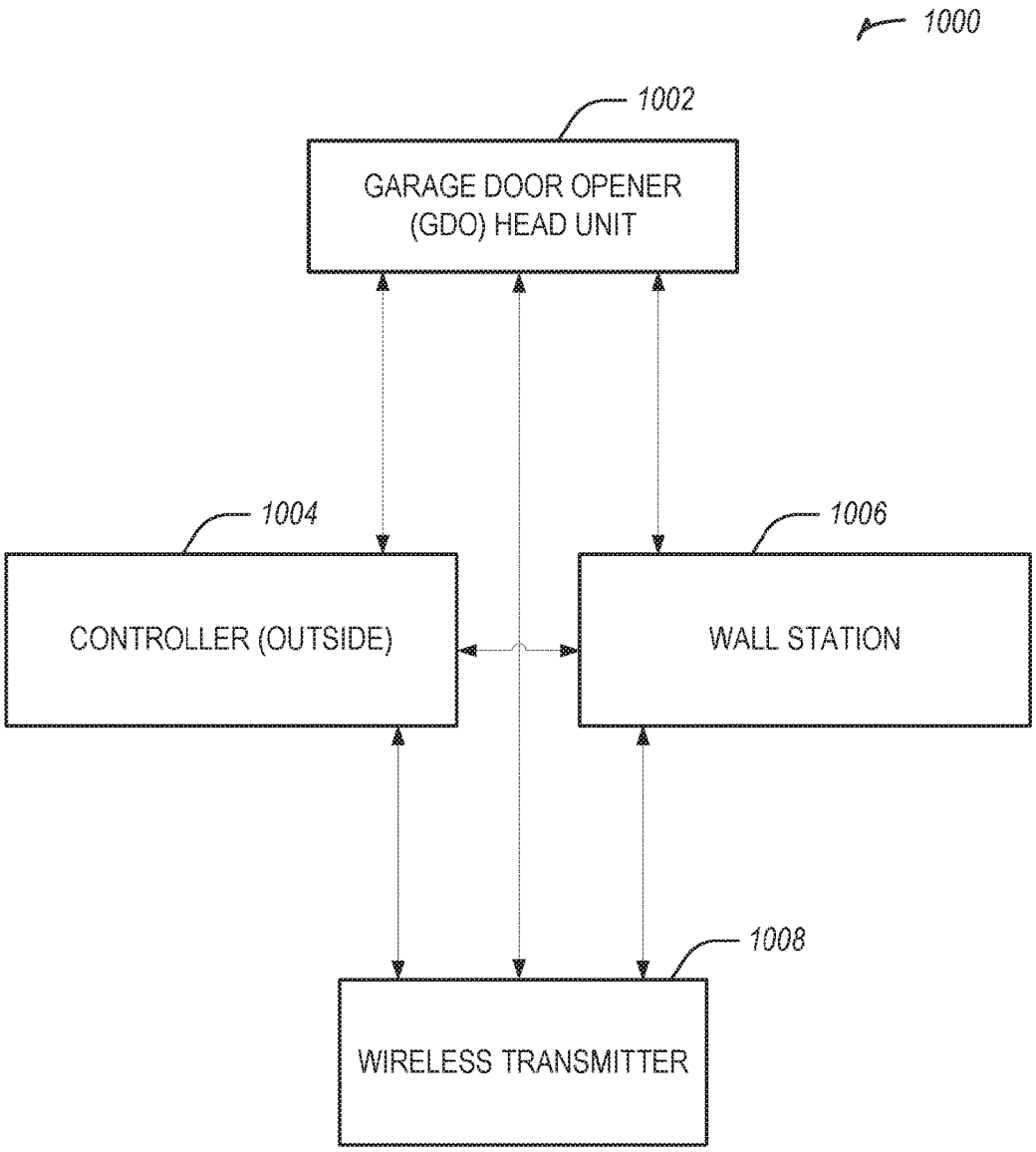
FIG. 10 illustrates a block diagram showing components of a barrier opener system in accordance with some embodiments.

FIG. 10 illustrates a block diagram showing components of a barrier opener system 1000 in accordance with some embodiments. The barrier opener system 1000 includes a motorized barrier operator 1002, a controller 1004, a wall station 1006, and a wireless transmitter 1008. The controller 1004 can be located physically outside of a room, such as a garage. The wall station 1006 can be located physically inside the room, with the motorized barrier operator 1002. The wireless transmitter 1008 can be portable. The controller 1004, the wall station 1006, and the wireless transmitter 1008 can be used to control the motorized barrier operator 1002, which can be controlled to open or close a door, such as a barrier. When the motorized barrier operator 1002 is configured to communicate wirelessly, the motorized barrier operator 1002 can communicate directly with the wireless transmitter 1008 or the controller 1004.

When the motorized barrier operator 1002 is not configured to communicate wirelessly, the motorized barrier operator 1002 can communicate using a wired connection with the wall station 1006. The wall station 1006 can include a wireless receiver to receive commands from the controller 1004 or the wireless transmitter 1008 and relay the commands to the motorized barrier operator over the wired connection. The wireless transmitter 1008 can send commands to the controller 1004 or the wall station 1006 which can then relay the commands to the motorized barrier operator 1002. In an example, the wireless transmitter 1008 can send a command to the controller 1004 wirelessly, which can then relay the command wirelessly to the wall station 1006, which can then relay the command over a wired connection to the motorized barrier operator 1002. In another example, the controller 1004 can wirelessly communicate a command to the wall station 1006, which can then relay the command over a wired connection to the motorized barrier operator 1002.

Figure 11:
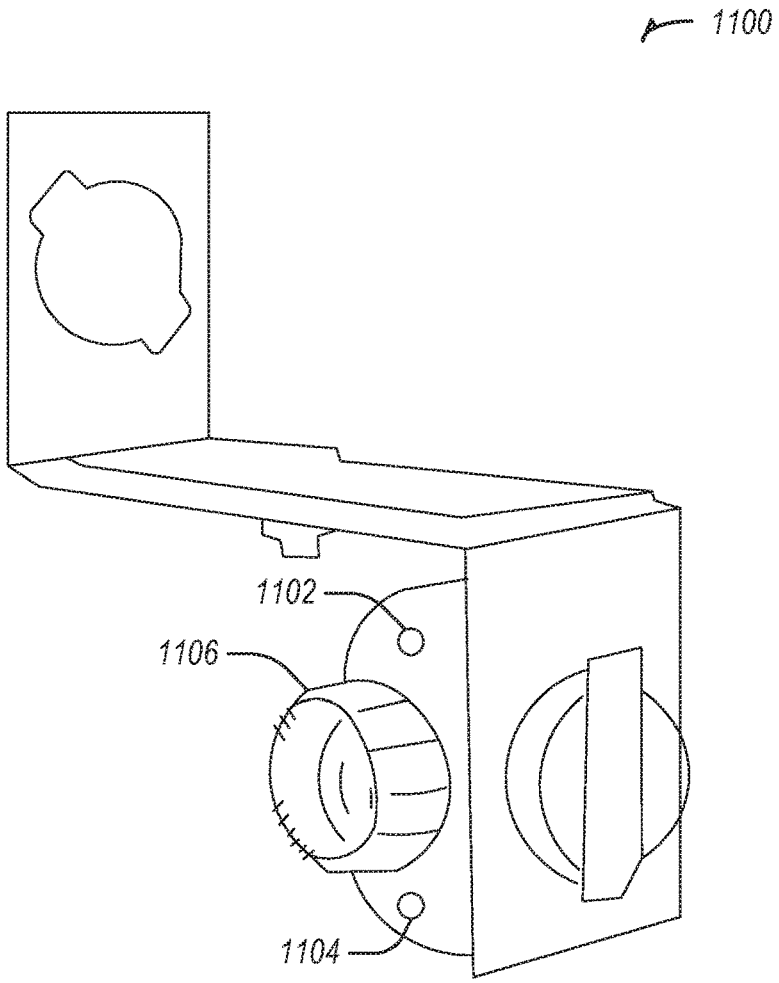
FIG. 11 illustrates a safety beam apparatus in accordance with some embodiments.

FIG. 11 illustrates a safety beam apparatus 1100 in accordance with some embodiments. The safety beam apparatus 1100 can include a first light 1102 and a second light 1104. The first light 1102 can be used to indicate that the safety beam apparatus 1100 is powered. This light can be omitted. The second light 1104 can be used to indicate whether a beam is aligned. The emitter 1106 can be used to emit a beam of light, such as an infrared light beam. In an example, the first light 1102 can be a green LED and the second light 1104 can be a red LED.

When the first light 1102 is on, and the second light 1104 is off, a receiver portion of the safety beam apparatus 1100 (shown in FIG. 11) has power but is not detecting the infrared beam from a sender portion of the safety beam apparatus 1100 (not shown in FIG. 11). In another example, the sender and receive portions can be in a single apparatus (e.g., using a reflective beam). The second light 1104 can flash when the beam is partially detected. The detection failure can be caused by misalignment of the receiver portion or sender portion, or something blocking the beam. The sender portion or receiver portion can be adjusted and when the second light 1104 is lit, the alignment is proper. When the second light 1104 stays on, the sender portion can be rotated up and stopped when the second light 1104 on the receiver portion begins to flicker. Rotating the sender portion back towards a horizontal position, such as level with a floor and stopping when the second light 1104 on the receiver portion is solid can result in a proper alignment. The various conditions of the first light 1102 (green) and the second light 1104 (red) are shown below in Table 2.

TABLE 2

| Safety Beam Indications SAFETY BEAM INDICATOR TABLE | |
|---|---|
| GREEN ON | POWER ON |
| GREEN OFF | POWER OFF |
| RED ON | BEAM OK—NO BLOCKAGE |
| RED OFF | BEAM BLOCKED OR MIS-ALIGNED |
| RED FLASHING | BEAM ALIGNED POORLY |

When the beam of the safety beam apparatus 1100 is interrupted and the door is moving down, the door can reverse and move up or stop. If the door is moving up when the beam is interrupted, the door can stop or continue moving up. In an example, when the beam is interrupted, a motorized barrier operator can ignore a received command to close. For example, if the motorized barrier operator receives a command directly or indirectly from a wall station, controller, or wireless transmitter to close the door and the beam is blocked, the motorized barrier operator can remain idle.

In an example, if a door corresponding to the safety beam apparatus 1100 remains idle for 5 minutes, the second light 1104, the first light 1102, or the beam can turn off to save power. The beam power can turn on for 5 minutes when the door moves down to the fully closed position. In an example, the beam power can be restored for 5 minutes when a light button is pressed (e.g., on a wall station or controller).

The safety beam apparatus 1100 can be configured to output an infrared beam, monitor the infrared beam, and in response to determining that the infrared beam has been disrupted, stop a barrier from moving. In an example, the safety beam apparatus 1100 can then reverse the barrier if the barrier was previously moving down. In another example, the first light 1102 is a power light and the second light 1104 is an alignment light, the power light indicating whether the safety beam apparatus 1100 has power and the alignment light indicating whether a light emitter that emits the infrared beam is aligned with a light receiver.

Figure 12:
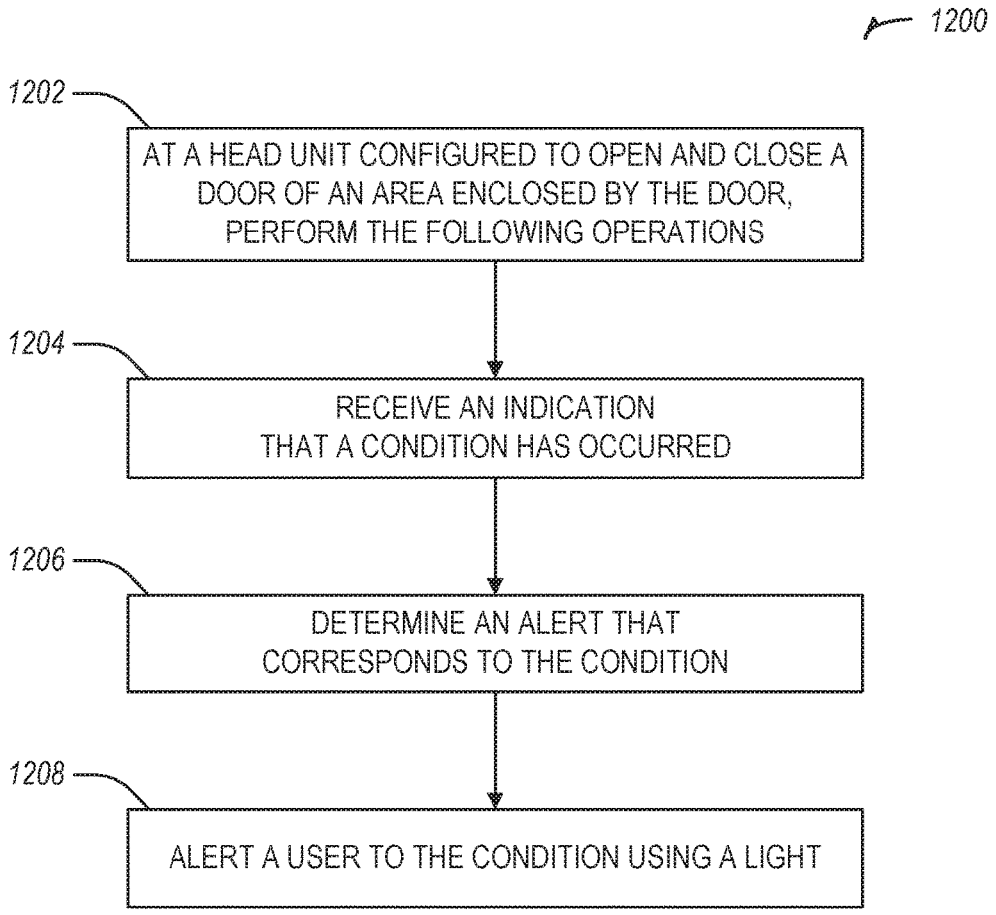
FIG. 12 illustrates a flowchart showing a technique 1200 for controlling a door opener system in accordance with some embodiments.

FIG. 12 illustrates a flowchart showing a technique 1200 for controlling a door opener system in accordance with some embodiments. The technique 1200 includes an operation 1202 to, at a head unit configured to open and close a door of an area enclosed by the door, perform the following operations. The technique 1200 includes an operation 1204 to receive an indication that a condition has occurred. Receiving the indication can include receiving the indication from a wireless device, such as a controller or a wireless transmitter, via a wall station. The condition can include an obstruction blocking the door, a safety beam obstacle, a loss of power, a shorted wire, etc.

The technique 1200 includes an operation 1206 to determine an alert that corresponds to the condition. The alert can be determined from memory of the head unit. The technique 1200 includes an operation 1208 to alert a user to the condition using a light or an audible alarm. For example, the light can be on the head unit. The light can alert the user by using a distinct count of flashes of the light. The distinct count can correspond to the alert for the condition. For example, flash a first distinct number of times for the obstruction blocking the door, flash a second distinct number of times for the safety beam obstacle, flash a third distinct number of times for a loss of power, flash a fourth distinct number of for a shorted wire, flash a fifth distinct number of times for another condition, etc. The technique 1200 can include wherein the wireless device is outside the area enclosed by the door and the wall station is inside the area enclosed by the door.

VARIOUS NOTES & EXAMPLES

Each of these non-limiting examples can stand on its own, or can be combined in various permutations or combinations with one or more of the other examples.

Example 1 is a barrier opener system comprising: a motorized barrier operator configured to open and close a barrier of an area enclosed by the barrier, the motorized barrier operator including a light connected to control circuitry, the light configured to provide general illumination around the motorized barrier operator, and the control circuitry configured to alert a user using one or more of a sequence or count of flashes of the light corresponding to a respective condition; a wall station configured to be located inside the area enclosed by the barrier and to communicate with the motorized barrier operator to cause the motorized barrier operator to open and close the barrier; a controller configured to be located outside the area enclosed by the barrier, the controller including a light button, the light button configured to activate a light on the motorized operator when pressed; and a wireless transmitter configured to be portable.

In Example 2, the subject matter of Example 1 optionally includes wherein the light is configured to use distinct counts of flashes for respective conditions.

In Example 3, the subject matter of Example 2 optionally includes wherein the light is configured to flash using: a first count to indicate that the wall station is miswired; a second count to indicate a safety beam obstacle; and a third count to indicate an obstruction mechanically interfering with movement of the barrier.

In Example 4, the subject matter of any one or more of Examples 1-3 optionally include wherein the light is configured to indicate a wireless connection with the controller or the wireless transmitter.

In Example 5, the subject matter of any one or more of Examples 1-4 optionally include wherein the wireless transmitter is configured to acquire a dual in-line package (DIP) switch setting from another device and to emulate a security protocol using the acquired DIP switch setting when a button is pressed.

In Example 6, the subject matter of Example 5 optionally includes wherein the wireless transmitter is configured to remove the DIP switch setting and return to a default function when the button is pressed.

Example 7 is a motorized opener system comprising: a motorized barrier operator configured to open and close a barrier to an area enclosed at least in part by the barrier; a wall station configured to be located inside the area enclosed at least in part by the barrier and configured to communicate with the motorized barrier operator to cause the motorized barrier operator to open and close the barrier; and a controller configured to be located outside the area enclosed by the barrier, the controller including a light button, the light button configured to activate a light on the motorized barrier operator when pressed, and the controller configured to acquire a dual in-line package (DIP) switch setting from a wireless transmitter.

In Example 8, the subject matter of Example 7 optionally includes wherein the motorized barrier operator includes a configuration button, the configuration button configured to initiate a connection with the controller or the wireless transmitter.

In Example 9, the subject matter of any one or more of Examples 7-8 optionally include wherein the wall station includes a light controller, the light controller configured to activate a light on the motorized barrier operator.

In Example 10, the subject matter of any one or more of Examples 7-9 optionally include wherein the wall station includes a locking feature, the locking feature configured to, when activated, prevent the wireless transmitter from causing the motorized barrier operator to open the barrier.

In Example 11, the subject matter of any one or more of Examples 7-10 optionally include wherein the controller is to communicate with the motorized barrier operator to cause the motorized barrier operator to open and close the barrier.

In Example 12, the subject matter of any one or more of Examples 7-11 optionally include wherein the controller is to send a command to the wall station to communicate with the motorized barrier operator to cause the motorized barrier operator to open and close the barrier.

In Example 13, the subject matter of any one or more of Examples 7-12 optionally include wherein the controller is configured to wirelessly communicate with the wall station, and wherein the controller is to receive a command from the wireless transmitter and forward the command to the wall station.

In Example 14, the subject matter of any one or more of Examples 7-13 optionally include wherein the wall station is configured to wirelessly communicate with the wireless transmitter.

In Example 15, the subject matter of any one or more of Examples 7-14 optionally include a safety beam apparatus, the safety beam apparatus configured to: output an infrared beam; monitor the infrared beam; and in response to determining the infrared beam has been disrupted, one or more of stop the barrier from moving or reverse a barrier transit direction to open the barrier.

In Example 16, the subject matter of Example 15 optionally includes wherein the safety beam apparatus includes a power light and a separate alignment light, the power light indicating whether the safety beam apparatus has power and the alignment light indicating whether a light emitter that emits the infrared beam is aligned with a light receiver.

In Example 17, the subject matter of any one or more of Examples 7-16 optionally include wherein the motorized barrier operator includes a carbon monoxide detector, and the motorized barrier operator is configured to automatically open the barrier when the carbon monoxide detector detects a carbon monoxide concentration above a threshold.

Example 18 is a method for controlling a barrier opener system, the method comprising: at a motorized barrier operator configured to open and close a barrier of an area enclosed by the barrier: receiving, from a wireless device via a wall station, an indication that a condition has occurred, the condition including an obstruction blocking the barrier; determining, from memory of the motorized barrier operator, an alert that corresponds to the condition; alerting a user to the condition using a light on the motorized barrier operator by using a distinct count of flashes of the light, the distinct count corresponding to the alert for the condition; and wherein the wireless device is outside the area enclosed by the barrier and the wall station is inside the area enclosed by the barrier.

In Example 19, the subject matter of Example 18 optionally includes wherein the light includes a Light Emitting Diode (LED).

In Example 20, the subject matter of any one or more of Examples 18-19 optionally include wherein the motorized barrier operator includes an expansion port, the expansion port configured to interface with the wireless device.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code can form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) can be used in combination with each other. Other embodiments can be used, such as by one of ordinary skill in the art upon reviewing the above description. The Abstract is provided to comply with 37

C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A barrier opener system comprising:

a motorized barrier operator configured to open and close a barrier of an area enclosed by the barrier, the motorized barrier operator including a light connected to control circuitry, the light configured to provide general illumination around the motorized barrier operator, and the control circuitry configured to alert a user using one or more of a sequence or count of flashes of the light corresponding to a respective condition;

a wall station configured to be located inside the area enclosed by the barrier and to communicate with the motorized barrier operator to cause the motorized barrier operator to open and close the barrier;

a controller configured to be located outside the area enclosed by the barrier, the controller including a light button, the light button configured to activate the light on the motorized operator when pressed;

a wireless transmitter configured to be portable; and wherein the wall station is further configured to receive an indication that a condition has occurred and determine an alert that corresponds to the condition, and wherein the light is configured to alert a user by using a distinct count of flashes corresponding to the alert for the condition.

2. The system of claim 1, wherein the light is configured to indicate a wireless connection with the controller or the wireless transmitter.

3. The system of claim 1, wherein the wireless transmitter is configured to acquire a dual in-line package (DIP) switch setting from another device and to emulate a security protocol using the acquired DIP switch setting when a button is pressed.

4. The system of claim 3, wherein the wireless transmitter is configured to remove the DIP switch setting and return to a default function when the button is pressed.

5. A motorized opener system comprising:

a motorized barrier operator configured to open and close a barrier to an area enclosed at least in part by the barrier;

a wall station configured to be located inside the area enclosed at least in part by the barrier and configured to communicate with the motorized barrier operator to cause the motorized barrier operator to open and close the barrier; and a controller configured to be located outside the area enclosed by the barrier, the controller including a light button, the light button configured to activate a light on the motorized barrier operator when pressed, and the controller configured to acquire a dual in-line package (DIP) switch setting from a wireless transmitter; and wherein the wall station is further configured to receive an indication that a condition has occurred and determine an alert that corresponds to the condition, and wherein the light is configured to alert a user by using a distinct count of flashes corresponding to the alert for the condition.

6. The system of claim 5, wherein the motorized barrier operator includes a configuration button, the configuration button configured to initiate a connection with the controller or the wireless transmitter.

7. The system of claim 5, wherein the wall station includes a light controller, the light controller configured to activate the light on the motorized barrier operator.

8. The system of claim 5, wherein the wall station includes a locking feature, the locking feature configured to, when activated, prevent the wireless transmitter from causing the motorized barrier operator to open the barrier.

9. The system of claim 5, wherein the controller is to communicate with the motorized barrier operator to cause the motorized barrier operator to open and close the barrier.

10. The system of claim 5, wherein the controller is to send a command to the wall station to communicate with the motorized barrier operator to cause the motorized barrier operator to open and close the barrier.

11. The system of claim 5, wherein the controller is configured to wirelessly communicate with the wall station, and wherein the controller is to receive a command from the wireless transmitter and forward the command to the wall station.

12. The system of claim 5, wherein the motorized barrier operator further includes a disengagement lever, the disengagement lever configured to disengage the motorized barrier operator from the barrier, wherein the disengagement lever is configured to be inoperable from outside the barrier.

13. The system of claim 5, comprising a safety beam apparatus, the safety beam apparatus configured to:

output an infrared beam;

monitor the infrared beam; and in response to determining the infrared beam has been disrupted, one or more of stop the barrier from moving, reverse a barrier transit direction to open the barrier, or prevent the barrier from moving in a transit direction to close the barrier.

14. The system of claim 13, wherein the safety beam apparatus includes a power light and a separate alignment light, the power light indicating whether the safety beam apparatus has power and the alignment light indicating whether a light emitter that emits the infrared beam is aligned with a light receiver.

15. The system of claim 5, wherein the motorized barrier operator includes a carbon monoxide detector, and the motorized barrier operator is configured to automatically open the barrier when the carbon monoxide detector detects a carbon monoxide concentration above a threshold.

16. A method for controlling a barrier opener system, the method comprising:

at a motorized barrier operator configured to open and close a barrier of an area enclosed by the barrier:

receiving, from a wireless device via a wall station, an indication that a condition has occurred;

determining, from memory of the motorized barrier operator, an alert that corresponds to the condition;

alerting a user to the condition using a light on the motorized barrier operator by using a distinct count of flashes of the light, the distinct count corresponding to the alert for the condition; and wherein the wireless device is outside the area enclosed by the barrier and the wall station is inside the area enclosed by the barrier.

17. The method of claim 16, wherein the motorized barrier operator includes an expansion port, the expansion port configured to interface with a wireless receiver to communicate with the wireless device.

18. The system of claim 1, wherein the light is configured to flash using: a first count to indicate that the wall station is miswired.

19. The system of claim 5, wherein the light is configured to flash using: a first count to indicate that the wall station is miswired.

20. The method of claim 16, wherein the condition includes a safety beam obstacle, a loss of power, or a shorted wire.

* * * * *